United States Patent [19]

Arps et al.

[11] Patent Number: 4,923,328

[45] Date of Patent: May 8, 1990

[54] MAINTAINABLE EXPANSION JOINT FOR HIGHWAYS, BRIDGES AND THE LIKE

[75] Inventors: David H. Arps; Howard R. Brown, both of Bowling Green; Roy J. Lanham, Cygnet; Donald E. Weiker, Portage, all of Ohio

[73] Assignee: The D. S. Brown Company, Inc., North Baltimore, Ohio

[21] Appl. No.: 300,280

[22] Filed: Jan. 19, 1989

[51] Int. Cl.[5] ..... E01C 11/04

[52] U.S. Cl. ..... 404/69; 52/396

[58] Field of Search ..... 404/47, 49, 50, 56, 404/63, 68, 69; 52/396

[56] References Cited

U.S. PATENT DOCUMENTS

| | | | |
|---|---|---|---|
| 4,271,650 | 6/1981 | Lynn-Jones | 404/69 X |
| 4,339,214 | 7/1982 | Puccio et al. | 404/69 |
| 4,674,252 | 6/1987 | Nicholas et al. | 404/69 X |
| 4,774,795 | 10/1988 | Braun | 404/68 X |

OTHER PUBLICATIONS

Maurer-Expansion Joints, The D. S. Brown Company, 1987.

*Primary Examiner*—William P. Neuder

*Attorney, Agent, or Firm*—Willian Brinks Hofer Gilson & Lione

[57] ABSTRACT

An expansion joint for use between spaced apart ends of adjacent sections of a highway, bridge or the like, the expansion joint having a pair of aligned boxes embedded in the pavement material of the ends of the sections, one or more support rails each of which is slidingly supported at its opposed ends in the aligned boxes, and one or more intermediate rails between the spaced apart ends and extending transversely of the support rails, each of the intermediate rails being affixed to and supported thereby. Each of the boxes has a removable top plate whose top surface is coplanar with the driving surface of the highway, bridge or the like, the top surface having a steel plate with upper and lower layers of an organic material affixed to its upper and lower surfaces, respectively. The metal plate is secured to an upstanding wall of the metal box by threaded fasteners each of which has its top below the top surface of the upper layer of the organic material, the upper layer having holes therein to permit the insertion and removal of the threaded fasteners. A removable plug of an organic material is removably inserted into each of the holes in the upper layer to seal such holes.

55 Claims, 5 Drawing Sheets

MAINTAINABLE EXPANSION JOINT FOR HIGHWAYS, BRIDGES AND THE LIKE

BACKGROUND OF THE INVENTION

1. Field of the Invention

This invention relates to an expansion joint for use between spaced-apart ends of adjacent sections of a highway, bridge or the like to sealingly accommodate changes in the spacing between the sections as a result of thermal contraction and expansion. More particularly, this invention relates to an expansion joint of the foregoing character whose components are readily accessible for purposes of inspection and repair or replacement thereof without the need to destructively remove sections of the concrete pavement or other structure in which such expansion joint is incorporated.

2. Description of the Prior Art

Various types of expansion joints for highways, bridges and the like are known in the prior art for accommodating relatively large changes in spacing between the opposed ends of adjacent sections thereof as a result of thermal expansion and contraction. One of the popular types of these expansion joints is the so-called Maurer joint, which is named after the West German firm that developed such joint. A Maurer joint incorporates opposed sets of boxes which are fabricated from a metallic material, usually a rolled carbon steel, and which are embedded at spaced apart locations in the opposed ends of adjacent sections of a highway, for example. One or more intermediate rails extending transversely of the sections are placed between the adjacent sections and are supported on support rails which extend between the metal boxes and transversely of the intermediate rails which are supported thereby. The support rails, in turn, are supported at their ends in the fabricated boxes. Springs are usually placed on opposite sides of each of the support rails to center each intermediate rail, each of which is attached to one of the support rails, between adjacent intermediate rails. Elastomeric membranes are placed between an edge rail at the edge of each section of the highway and the intermediate rail which is adjacent to it, and between each adjacent pair of intermediate rails in an expansion joint having two or more of such intermediate rails, to seal the expansion joint against the ingress of water, dirt and debris, to thereby prevent corrosion or other damage to the elements of the expansion joint or damage to the ends of the highway which incorporates the expansion joint.

Heretofore, in a Maurer joint of the foregoing character the tops of the fabricated metal boxes thereof were positioned below the driving surface of the highway which incorporates such metal boxes, with an appreciable depth of concrete or other pavement material placed thereover to protect the metal boxes and their components from the ingress of water, dirt and debris. Unfortunately, in such a construction it is not possible to inspect the metal boxes and their components after the covering thereof with the pavement material, or to repair or replace the metal boxes or any of their components, without destructively removing the covering layer of pavement material. Thus, the inspection and maintenance of known types of Maurer expansion joints, as described, is a rather time-consuming and expensive procedure.

SUMMARY OF THE INVENTION

According to the present invention there is provided an expansion joint for sealingly accommodating changes in spacing between opposed ends of adjacent sections of a highway, bridge or the like, the expansion joint generally being of the Maurer type, as heretofore described, but whose fabricated metal boxes have removable top plates whose top surfaces are at driving level. The placement of the metal box top plates in this manner permits ready and rapid removal of each metal top plate for inspection of the metal box thereunder, and repair or replacement of the components of the expansion joint therein without the need to destructively remove any portion of the pavement material. Each top plate is metallic with a covering along its top surface, each side edge and rear edge and its bottom surface of an organic material. The organic covering material, while quite hard relative to other organic materials, is somewhat softer than steel, and thus serves as an effective gasket to seal the side and rear edges of the top plate from adjacent surfaces of the highway in which it is placed, and to serve as a gasket between the bottom of the top plate and the tops of the sides of the metal box to which it is attached, by bolting. Further, the organic material on the top surface of the top plate serves as a vibration damper to prevent the vibrations from the road traffic from loosening the bolts which retain the top plate in place, and otherwise damaging the elements of the expansion joint.

Accordingly, it is an object of the present invention to provide an improved expansion joint for sealingly accommodating changes in spacing between the opposed ends of adjacent sections of a highway, bridge or the like. More particularly, it is an object of the present invention to provide an expansion joint of the foregoing character whose components are readily accessible for inspection and maintenance, without the need to destructively remove any pavement material from the highway, bridge or the like which incorporates such expansion joint. It is also an object of the present invention to provide a readily maintainable expansion joint of the foregoing character whose elements are dampened from excessive road traffic vibrations to prevent disengagement thereof during service.

For a further understanding of the present invention and the objects thereof, attention is directed to the drawing and the following brief description thereof, to the detailed description of the preferred embodiment and to the appended claims.

DETAILED DESCRIPTION OF THE PREFERRED EMBODIMENT

Figure 1:
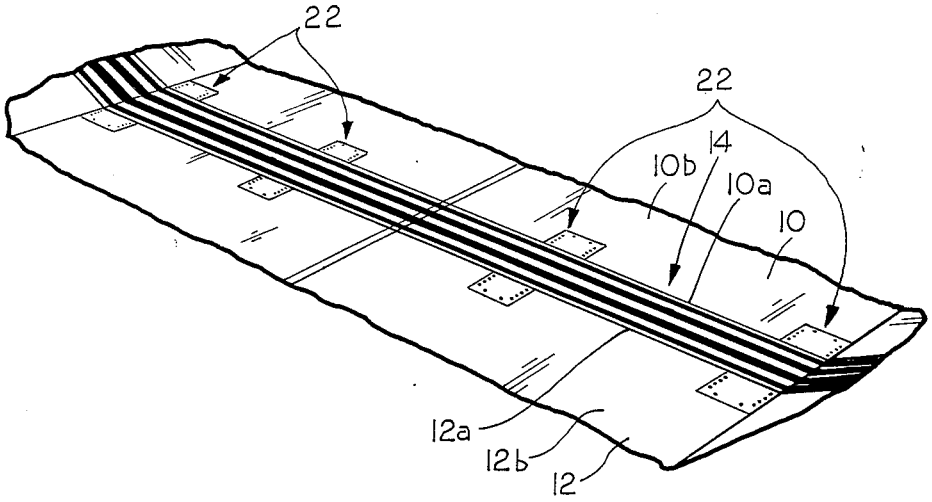
FIG. 1 is a fragmentary, perspective view of a section of a high incorporates an expansion joint according to the preferred embodiment of the present invention.

As is illustrated in FIG. 1, a typical highway includes multiple concrete sections, such as sections 10 and 12, whose adjacent ends 10*a* and 12*a*, respectively, are spaced apart from one another to accommodate thermal expansion and contraction of the sections 10 and 12 due to temperature changes. An expansion joint, indicated generally at 14, is inserted in the space between the ends 10*a* and 12*a* of the sections 10 and 12 to form a bridge therebetween and to thereby minimize the irregularity in the top surface of the highway which incorporates the sections 10 and 12. Without an expansion joint such as the expansion joint 14, the spacing between the ends 10*a* and 12*a*, which frequently can be of the order of at least several inches, can easily cause serious discomfort to the occupants of the vehicles which travel over such highway, possibly leading to a loss of control of the vehicle by its operator. As is shown in FIG. 1, the side edges of the highway sections 10 and 12 and the ends of the expansion joint 14 are upturned to form curbs.

Figure 3:
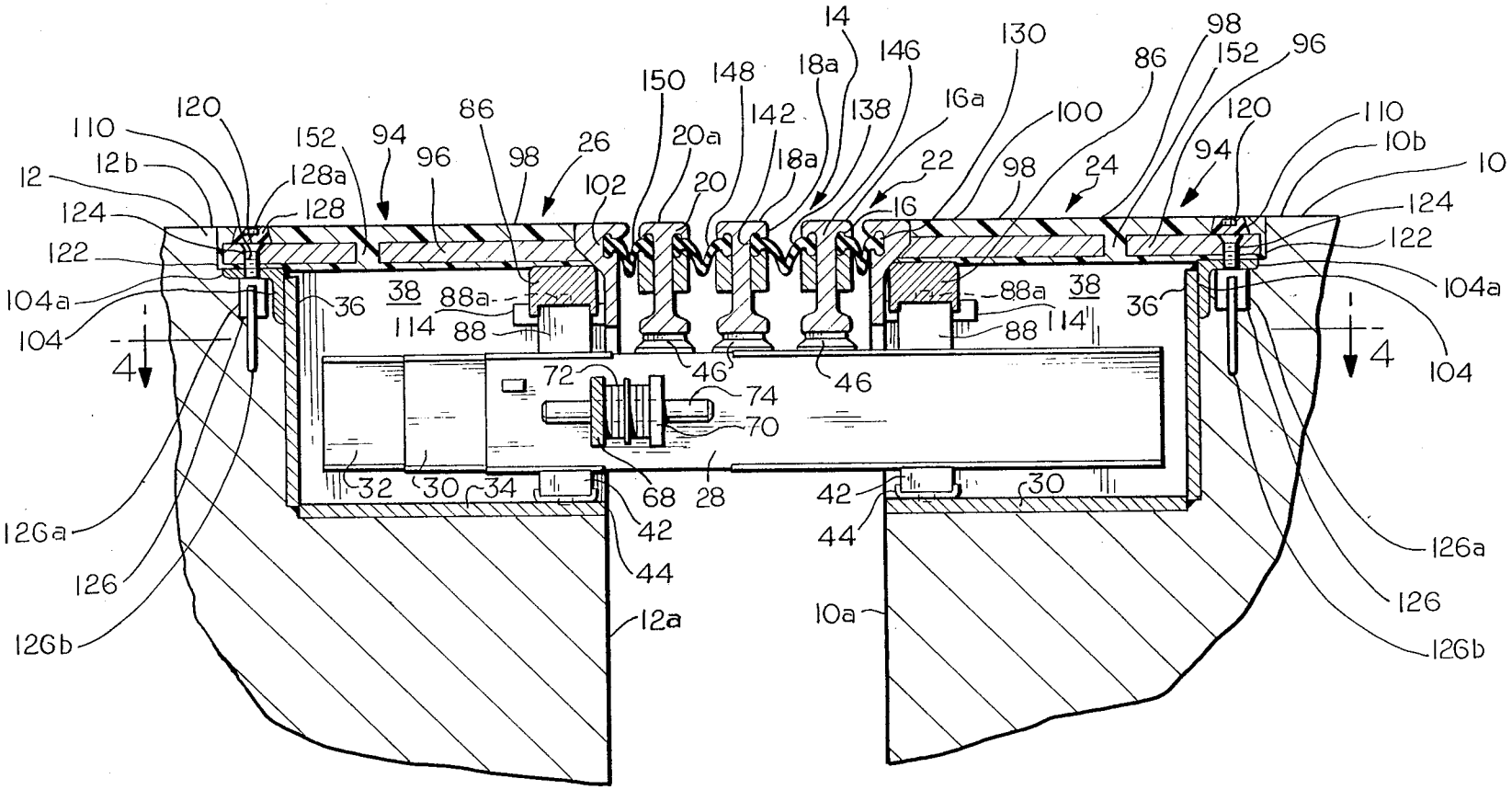
FIG. 3 is a sectional view taken on line 3—3 of FIG. 2.
Figure 4:
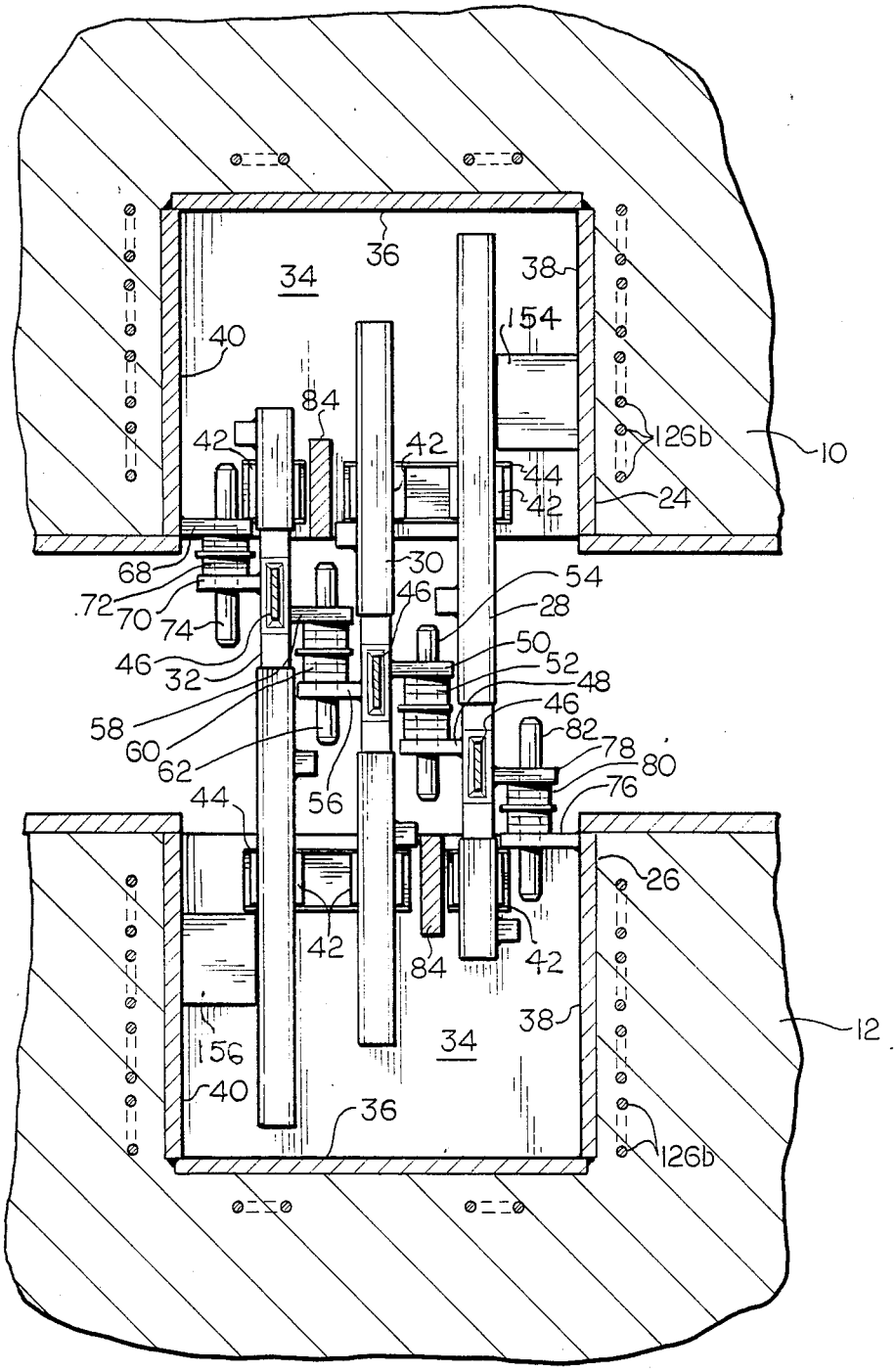
FIG. 4 is a sectional view taken on line 4—4 of FIG. 3.

The expansion joint 14 includes at least one, and, preferably, a plurality of intermediate rails, shown on the drawing as three of such intermediate rails, 16, 18 and 20, and, typically, two or three of such intermediate rails, although it is known to use up to twelve of such intermediate rails, extending parallel to the opposed edges 10*a* and 12*a* of the highway sections 10 and 12 and spaced therebetween. As is shown in FIG. 3, when a plurality of intermediate rails are employed they are spaced apart from one another, preferably substantially equidistantly. Further, each of the intermediate rails 16, 18 and 20 is preferably I-shaped in cross-section, with horizontally extending top flanges 16*a*, 18*a* and 20*a*, respectively, to minimize the width of the gaps which can exist within the spacing between the ends 10*a* and 12*a* of the sections 10 and 12, and to minimize the deflection of the intermediate rails 16, 18 and 20 under load. Further, the top surface of each of the sections 10 and 12, and the top surface of each of the flanges 16*a*, 18*a* and 20*a*, are positioned to be substantially coplanar with one another. Typically, an expansion joint 14 with three intermediate rails 16, 18 and 20 can accommodate a spacing variation between the opposed edges 10*a* and 12*a* of the sections 10 and 12, respectively, between maximum and minimum design temperatures, of up to approximately nine inches.

The intermediate rails 16, 18 and 20 of the expansion joint 14 are supported at a plurality of spaced apart locations, shown generally by reference numeral 22, across the width of the highway or bridge which incorporates such expansion joint, preferably at intervals of approximately five feet, to minimize deflection in the intermediate rails 16, 18 and 20 from vehicular traffic passing thereover. Each of the support locations 22 has an opposed pair of fabricated metal boxes 24 and 26 in the edges 10*a* and 12*a*, respectively, and the intermediate rails 16, 18 and 20 are affixed to, and are supported by, support rails 28, 30 and 32 which extend between the boxes 24 and 26, slidingly, as will hereinafter be more fully described, a separate support rail being provided for each of the intermediate rails 16, 18 and 20.

The boxes 24 and 26 are generally cubic in shape and each is provided with a bottom plate 34, and with a backplate 36 and opposed side plates 38 and 40 which are attached to the bottom plate 34. In the normal orientation of the expansion joint 14 each bottom plate 34 is oriented in a substantially horizontal plane, and the backplate 36 and the side plates 38 and 40 which are attached thereto extend substantially vertically upwardly therefrom. The bottom edges of the side plates 38 and 40 are welded or otherwise affixed to the side edges of the bottom plate 34 and the bottom edge of the backplate 36 is welded or otherwise affixed to the back edge of the side plate 34. The welds between the bottom plate 34 and the backplate 36, on the one hand, and the welds between the bottom plate 34 and the side plates 38 and 40, on the other hand, preferably, are continuous in a U-shaped configuration. Further, the side edges of the backplate 36 extend vertically and are welded or otherwise affixed to the vertical rear edges of the side plates 38 and 40, respectively, preferably in continuous straight lineal patterns.

Figure 5:
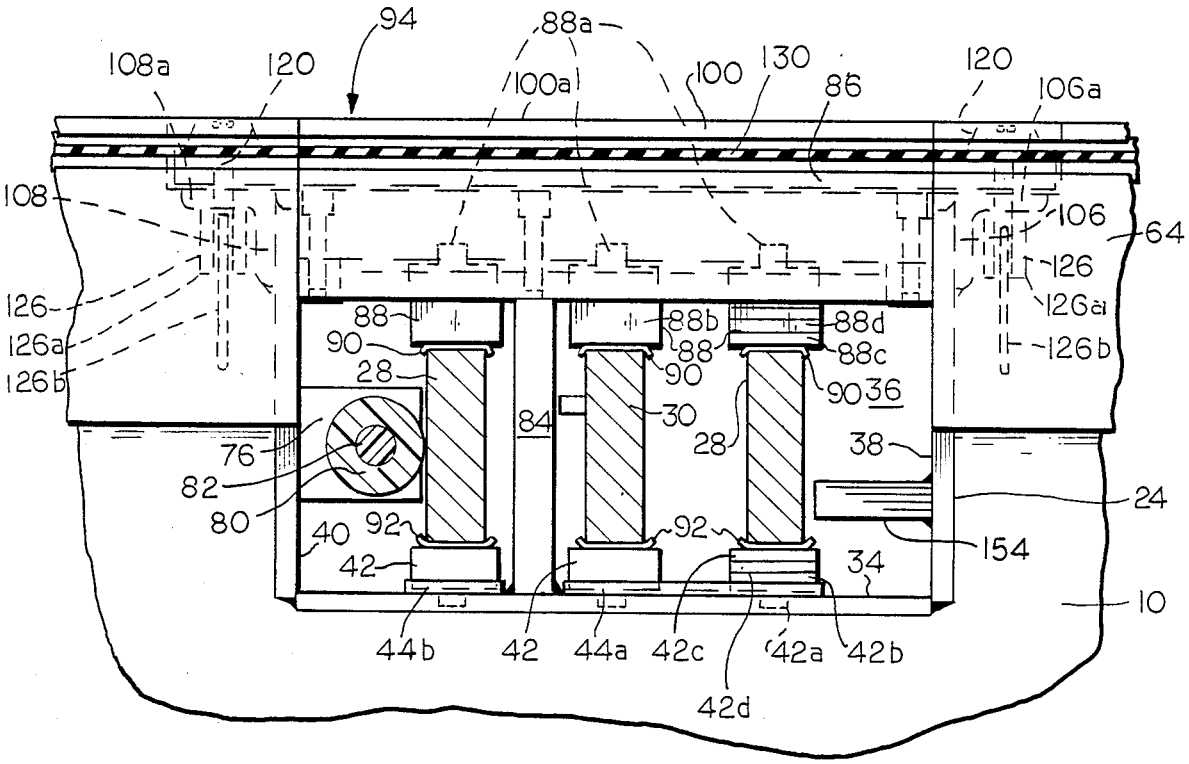
FIG. 5 is a sectional view taken on line 5—5 of FIG. 2.
Figure 2:
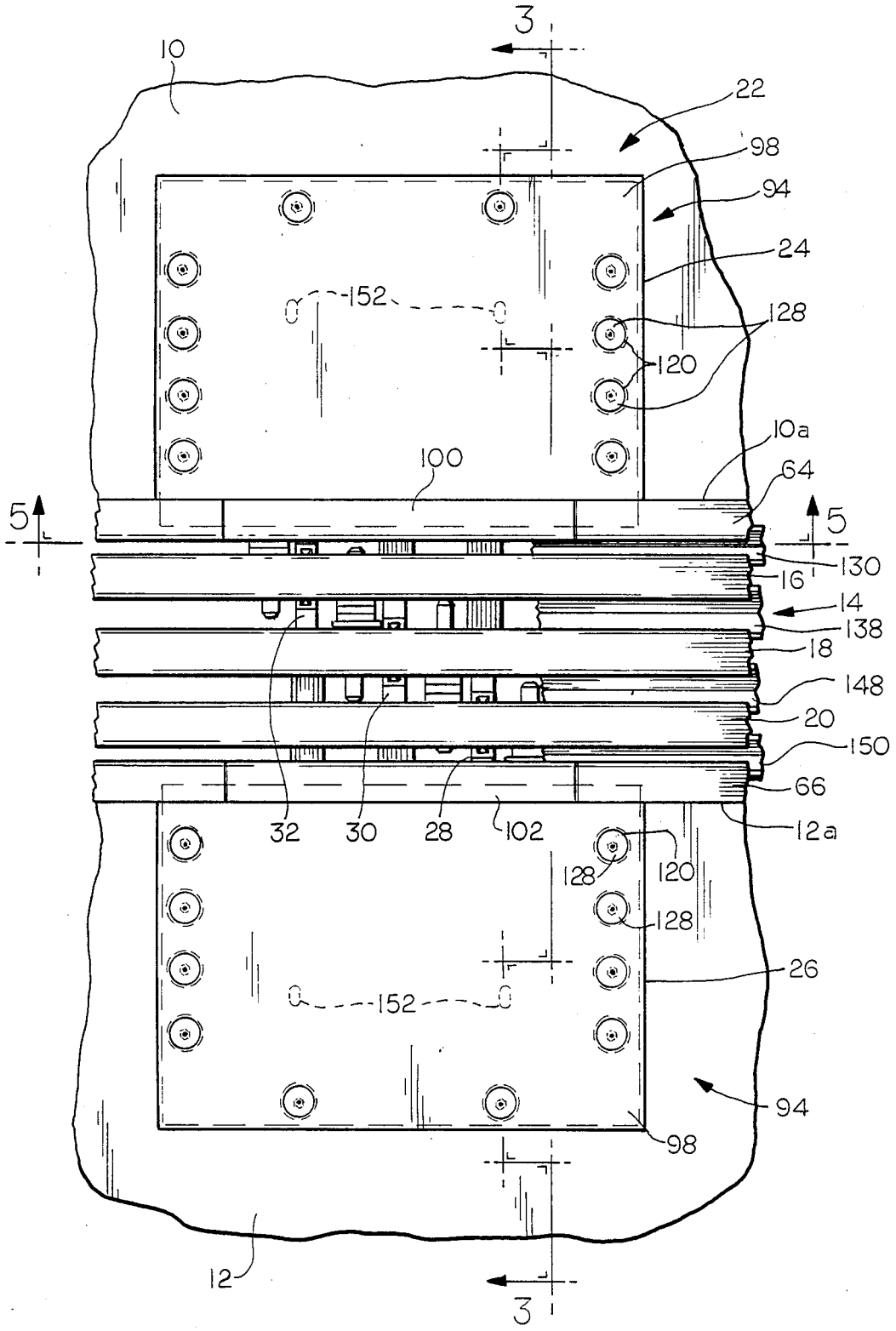
FIG. 2 is a fragmentary plan view, at an enlarged scale and partly broken away, of a portion of the expansion joint illustrate in FIG. 1.
Figure 6:
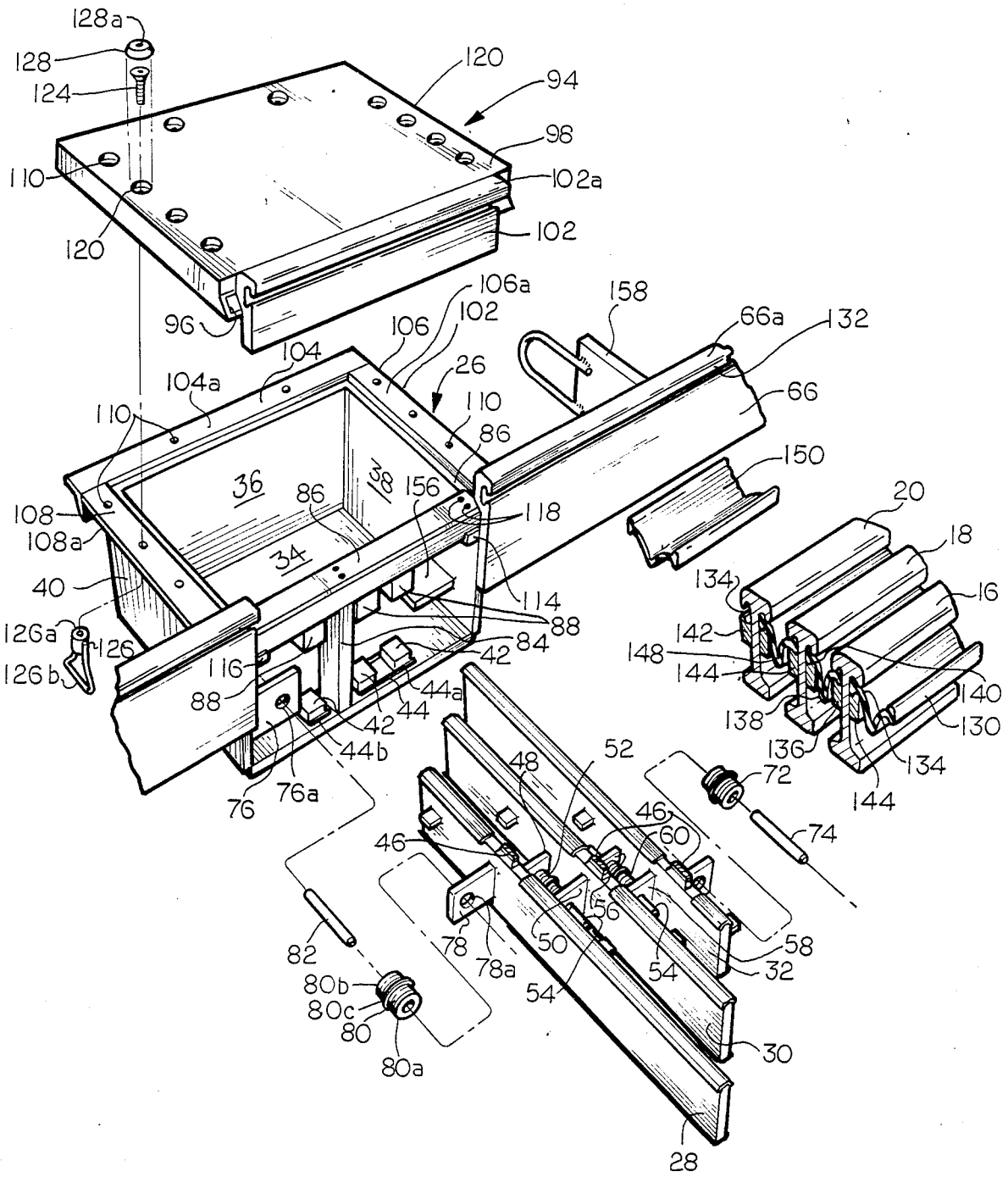
FIG. 6 is an exploded, perspective view illustrating certain of the components of the expansion joint of FIGS. 1–5.

The support rails 28, 30 and 32 are slidingly supported within the boxes 24 and 26 on flat bearing blocks 42, each of which is retained in the opening of an upwardly-facing channel-shaped retainer 44, preferably in the case of a pair of boxes 24 and 26 with at least three support rails, the retainer 44 being made up of separated sections 44*a* and 44*b* to accommodate the placement of an intermediate vertical support 84 between an adjacent pair of such support rails, as is shown most clearly in FIGS. 5 and 6. The retainer sections 44*a* and 44*b* are positioned near, but slightly inwardly from, the front edges of the boxes 24 and 26, that is, the edges which are away from the backplate 36 of each of such boxes, and may be secured in such positions by welding or the like. In any case, each bearing block 42, which is otherwise generally cubic in shape, has a cylindrical projection 42*a* on its bottom which projects through an opening, not shown, in the retainer 44 into a blind opening, not shown, in the bottom plate 34, so that each bearing block 42 is securely retained in place relative to the bottom plate 34 in spite of any side-to-side or front-to-back thrust loads which it may experience in service. As is shown in FIG. 5 in connection with the bearing block 42 under the support rail 28, each bearing block 42 preferably is of composite construction, having a relatively hard organic bottom layer 42*b*, such as a solid polyurethane elastomeric layer, a smooth, low friction top layer 42*c*, such as a polytetrafluroethylene (Teflon ®) layer, and an intermediate layer 42*d* which has good adherence characteristics relative to the top and bottom layers and which is at least as hard as the bottom layer, for example, a melamine formaldehyde layer, which is harder than polyurethane and which readily bonds both to polyurethane and to polytetrafluroethylene, suitable adhesives being used between such layers.

Each of the support rails 28, 30 and 32 has a raised pad 46 welded or otherwise securely affixed to its upper surface, and the one of the intermediate rails 16, 18 and 20 which is supported on such support rail is welded or otherwise securely affixed to the raised pad 46 thereon. Thus, clearance is maintained between the bottoms of each of the intermediate rails 16, 18 and 20 and thereof the support rails 28, 30 and 32 which are not intended to support it.

The spacing between the intermediate rails 16 and 18, and the spacing between the intermediate rails 18 and 20, are maintained at equal values as the spacing between the sections 10 and 12 increases and decreases by spring-loading the support rails 28, 30 and 32 in opposed directions which extend parallel to the movement between the road sections 10 and 12. Thus, the side of the support rail 28 which faces the support rail 30 has a flange 48 affixed thereto, as by welding, the side of the support rail 30 which faces the support rail 28 has a flange 50 similarly affixed thereto, the flange 50 being spaced from the flange 48, and an annular control spring 52 is trapped between the flange 48 and the flange 50, the control spring 52 being retained by a rod 54 which extends through openings, not shown, in the flanges 48 and 50 and through the annulus in the spring 52. Likewise, the side of the support rail 30 which faces the support rail 32 has a flange 56 affixed thereto, the side of the support rail 32 which faces the support rail 30 has a flange 58 affixed thereto, the flange 58 being spaced from the flange 56, and an annular control spring 60 is trapped in the space between the flange 56 and the flange 58 and is retained by a rod 62 which extends through openings in the flanges 56 and 58, not shown, and through the annulus in the spring 60.

The ends 10*a* and 12*a* of the sections 10 and 12 are provided with edge rails 64 and 66, respectively, along the free edges thereof, and the edge rails 64 and 66 are provided with top flanges 64*a* and 64*a*, respectively, whose top surfaces are substantially coplanar with the top surfaces of the top flanges 16*a*, 18*a* and 20*a* of the intermediate rails 16, 18 and 20. As is shown most clearly in FIG. 6 in connection with the edge rail 66, which is a mirror image of the edge rail 64, each such edge rail is discontinued between the side plates 38 and 40 of the box which is incorporated in such section to provide an opening in such box for the ends of the support rails 28, 30 and 32, and each such edge rail, preferably, has one or more anchoring devices 158 attached thereto to help anchor such edge rail in the concrete or other pavement material in which such edge rail is embedded. The intermediate rail 16 is spaced between the edge rail 64 and the intermediate rail 18, preferably approximately equidistantly, by further spring-loading the support rail 32, in a direction opposed to the loading imposed thereon by the spring 60. Thus, the inside of the side plate 40 of the box 24 has a flange 68 affixed thereto, the side of the support rail 32 which faces the side plate 40 of the box 24 has a flange 70 affixed thereto, the flange 70 being spaced from the flange 68, and an annular control spring 72 is trapped between the flange 68 and the flange 70, the control spring 72 being retained by a rod 74 which extends through openings, not shown, in the flanges 68 and 70 and through the annulus in the spring 72. Likewise, the inside of the side plate 38 of the box 26 has a flange 76 affixed thereto, the side of the support rail 28 which faces the side plate 38 of the box 26 has a flange 78 affixed thereto, the flange 78 being spaced from the flange 76, and an annular control spring 80 is trapped between the flanges 76 and 78, the control spring 80 being retained by a rod 82 which extends through openings 76*a* and 78*a* in the flanges 76 and 78, respectively, and through the annulus in the control spring 80. The control springs 80, 52, 60 and 72 have substantially equal spring coefficients, and in the arrangement heretofore described they will resist the opening of the joint to thereby help to maintain compression loadings on the pavement surrounding the boxes 24 and 26. Each of the control springs 80, 52, 60 and 72, preferably, is molded from expanded or cellular polyurethane of a density of approximately 0.67 grams per cubic centimeter, a construction which will provide a high spring coefficient, good durability, resistance to corrosion and light weight. As is shown in connection with the control spring 80 in FIG. 6, each such control spring is made up of axially aligned control spring segments, cellular polyurethane segments 80*a* and 80*b* in the case of the control spring 80, separated by a hard, molded solid polyurethane washer segment, segment 80*c* in the case of the control spring 80. The washer segment 80*c* serves to securely engage the rod 82, and the separation of the control spring functions into separate segments 80*a* and 80*b*, as opposed to a single control spring, helps to avoid an excessive bulge under compression loads.

Each of the boxes 24 and 26 has a cross member 86 extending thereacross, the cross member 86 extending between, and being secured to, each of the side plates 38 and 40 at locations near the top, front cover of each of the side plates, and having the general configuration of a downwardly facing channel. As shown, the cross member 86 is removably attached to the side plates 38 and 40 to permit its removal so that the components within the boxes 24 and 26 can be repaired or replaced, and this is done by providing each of the side plates 38 and 40 with inwardly extending flanges 114 and 116, respectively, by providing drilled and tapped holes 118 through the cross member 86 which are aligned with drilled and tapped holes (not shown) in the flanges 114 and 116, and by inserting cap screws, not shown, into the drilled and tapped holes 118 of the cross member to extend into the drilled and tapped holes of the flanges 114 and 116 therebelow. The cross member 86 is further supported between its ends by the top of the vertical support 84, which is welded or otherwise is-attached to the top surface of the bottom plate, when the cross member 86 is in its assembled position to minimize its deflection under load, and is drawn tight against the top of the vertical support 84 by cap screws (not shown) which extend through drilled and tapped holes 112 in the cross member 86 into aligned drilled and tapped holes (not shown) in the vertical support 84.

The support rails 28, 30 and 32 are pressed firmly against the bearing blocks 42 therebelow by bearing blocks 88 whose upper ends are retained in the channel of the cross member 86. Each bearing block 88, which is otherwise generally cubic in shape, has a cylindrical projection 88*a* which projects into a blind opening in the cross member 86. As is shown in FIG. 5 in connection with the bearing block 88 above the support rail 32, each bearing block 88 is preferably of composite construction, having a relatively hard organic top layer 88*b*, such as a solid polyurethane elastomer layer, a smooth low friction bottom layer 88*c*, such as PTFE, and an intermediate layer 88*d*, such as melamine formaldehyde, which is at least as hard, and preferably harder, than the top layer 88*b* and which readily bonds both to the top layer 88*b* and the bottom layer 88*c*, with suitable adhesives between such layers. Even though each end of each of the support rails 28, 30 and 32 is securely engaged by a bearing block 42 and a bearing block 88, each such support rail end can readily slide with respect to the bearing blocks 42 and 88 which engage it, as the expansion joint 14 opens and closes, because of the low friction layers 42 and 88*c* of such bearing blocks 42 and 88 which are in contact with such support rail. Further, each end of a support rail is provided with upper and lower stainless steel caps 90 and 92, respectively, which are affixed to such support rail. The longitudinal edges of the steel caps 90 and 92 are bent at oblique angles away from the adjacent bearing blocks 42 and 88, respectively, and the use of such steel caps 90 and 92 further reduces friction between such support rail end and the bearing blocks 42 and 88 which engage it.

Movement of the end of the support rail 32 which faces the side plate 38 of the box 24 toward such side plate, in the event of a twist load on the expansion joint 14, is limited by a plate 154 which is attached to the inside of such side plate 38. Similarly, movement of the end of the support rail 28 which faces the side plate 40 of the box 26 is limited by a plate 156 which is attached to such side plate.

Each of the boxes 24 and 26 is closed by a top plate of composite construction, such top plate being identified generally by reference numeral 94 and including a relatively thick steel plate 96 which is covered on its top, side and thick steel plate 96 which is covered on its top, side and back edges and bottom with a relatively hard, organic covering 98, such as a solid polyurethane elastomer covering, the layer of the covering 98 which is on top of the steel plate 96 being substantially thicker than the layer on the bottom of such steel plate. Further, front edges of the top plates 94 of the boxes 24 and 26 have edge rail segments 100 and 102, respectively, affixed thereto, such edge rail segments having upper flanges 100*a* and 102*a*, respectively, whose upper surfaces are substantially coplanar with the top surfaces of the flanges 16*a*, 18*a* and 20*a*. The edge rail segment 100 substantially bridges the interruption in the edge rail 64, and the edge rail segment 102 substantially bridges the interruption in the edge rail 66, slight cracks of the order of $\frac{1}{8}$ inch in width being necessary for proper clearance, so that, in service, the expansion joint 14 will include substantially uninterrupted edge rails made up of the edge rail 64 and the rail segment 100, in the case of the box 24, and the edge rail 66 and the rail segment 102 in the case of the box 26. After installation of each of the boxes 24 and 26, the narrow cracks between the edge rail segment 100 and the interrupted rail 64 and the narrow cracks between the edge rail segment 102 and the interrupted rail 66 are sealed by filling them with a suitable sealant, for example, a liquid polyurethane sealant such as Delcrete® sealant of the type sold by the assignee of this application. The steel plate 96 has a plurality of relatively small, spaced apart holes 152 therein to positively and integrally link the material in the top layer of the covering 98 with the material in the bottom layer. The covering of the steel plate 96 of the top plate 94 with the material of the covering 98 can be done by an open casting process using polyurethane in liquid form as the covering material and by then allowing the polyurethane to harden.

Each of the top plates 94 is affixed to the side plates more precisely to the outwardly projecting flanges 104*a*, 106*a* and 108*a* of inverted L-shaped members, such as structural steel angles 104, 106 and 108, respectively, which are affixed to the upper edges of the backplate 36, the side plate 38 and the side plate 40, respectively. The flanges 104*a*, 106*a* and 108*a* have their top surfaces aligned in a common plane which includes each such top surface, and the top surface of the cross member 86 lies in the same plane. Thus, the bottom, planar surface of the portion of the covering 98 which is on the underside of the steel plate 96 engages the top surfaces of the flanges 104*a*, 106*a* and 108*a* and the top surface of the cross member 86 in a substantially continuous, surface-to-surface rectangular plane to help seal each of the boxes 24 and 26 against the ingress of water, dirt and debris from thereabove. A plurality of spaced-apart bolt holes 110 are formed in the flanges 104*a*, 106*a* and 108*a*, and one or more drilled and tapped holes 112 is formed in the top surface of the cross member 86. A series of countersunk holes 114 are formed in the steel plate 96 of the top plate 94 in alignment with the bolt holes 110 in the flanges 104*a*, 106*a* and 108*a*, and a corresponding series of aligned holes 120 and 122 is formed in the top layer and in the bottom layer, respectively, of the covering 98 of the top plate 94, the holes 120 and 122 in the covering 98 being in alignment with the bolt holes 110. Flat head bolts 124 are inserted through the holes 120 with their heads being received in the countersunk portions of the holes 110 and their shanks extending through the holes 110 and 122 into threaded fasteners 126 which bottom against the underside of the flanges 104*a*, 106*a* and 108*a*. Preferably each threaded fastener 126 is an anchor to help to securely anchor the L-shaped members 104, 106 and 108 and, thus, the side plates 38 and 40 and the backplate 36 of each of the boxes 24 and 26 into the surrounding concrete or other pavement material. To this end, each threaded fastener 126 has an internally threaded annular portion 126*a* and a double-ended or generally U-shaped loop portion 126*b* whose ends are welded or otherwise affixed to the annular portion 126*a* and whose bight projects downwardly therefrom into the surrounding pavement material. The portion of the covering 98 on the underside of the steel plate 96 has sufficient yieldability, by virtue of its organic composition, to serve as an effective gasket between the top plate 94 and the portion of the box 24 or 26 therebelow.

The holes 120 in the top layer of the covering 98 have a reverse taper, that is, each such hole is smaller in diameter at the top thereof than at the bottom thereof. After the bolts 124 are in place, as heretofore described, the holes 120 are closed by reverse tapered organic plugs 128 which are inserted into the holes 120, the plugs 128, which are formed from a durable, yieldable material such as solid polyurethane, having a maximum outside diameter at the bottom thereof which is greater than the inside diameter at the top of the holes 120. Thus, the plugs 128, which can enter the holes 120 by a force fit as a result of the elastic yieldability of the material in the covering 98, help to ensure that the top surface of the covering 98 is relatively smooth, and they help to prevent moisture from accumulating in the holes 120, where it could lead to corrosion of the steel plate 96 and the bolts 124. Each plug 128 can be readily removed from its hole 120 by providing it with a small hole 128*a* above a blind internally threaded fastener (not shown) therebelow, by threading a bolt into the blind fastener and securely pulling on the head of the bolt.

The space between the edge rail 64, including the edge rail segment 100, and the side of the intermediate rail 16 which faces it is sealed by an elongate elastomeric membrane 130 which is generally in the form of a "V" with enlarged ear portions at its edges, the ear portions being sealingly engaged in generally C-shaped openings 132 and 134, respectively, in the edge rail 64 and in the intermediate rail 16, the opening in the intermediate beam 16 being formed, in part, by the underside of its top flange 16*a* and, in part, by a bar 136 which is affixed to the side of the web of the intermediate rail 16 which faces the edge rail 64. Similarly, the space between the intermediate rail 16 and the intermediate rail 18 is sealed by an elastomeric membrane 138, which is similar to the elastomeric membrane 130 and which has ear portions sealingly engaged in generally C-shaped openings 140 and 142 in the intermediate rails 16 and 18, respectively, which are formed, in part, by the under-sides of the top flanges 16*a* and 18*a*, respectively, and, in part, by bars 144 and 146 which are affixed to the facing sides of the webs of the intermediate rails 16 and 18, respectively, the space between the intermediate rail 18 and the intermediate rail 20 is sealed by an elastomeric membrane 148 and the space between the intermediate rail 20 and the edge rail 66, including the edge rail segment 102, is sealed by an elastomeric membrane 150. Each of the elastomeric membranes is formed from an elastomeric material such as polychloroprene (Neoprene) with a Durometer A hardness of approximately 60±5, and this can readily be done by extrusion. Preferably, each of the elastomeric membranes corresponds to the membrane of the "Highway Expansion Joint Strip Seal" which is described in a copending U.S. patent application of Howard R. Brown, Ser. No. 272,529, filed on Nov. 17, 1988, an application which is assigned to the assignee of this application. However, other known types of elastomeric membranes, for example, elastomeric membranes corresponding to that described in U.S. Pat. No. 4,290,713 (D.D. Brown), which is also assigned to the assignee of this application, can also be used.

Although the best mode contemplated by the inventors for carrying out the present invention as of the filing date hereof has been shown and described herein, it will be apparent to those skilled in the art that suitable modifications, variations, and equivalents may be made without departing form the scope of the invention, such scope being limited solely by the terms of the following claims.

What is claimed is:

1. An expansion joint for use between spaced apart ends of adjacent sections of a structure which a vehicle is adapted to drive over, the structure having a top driving surface, each of the sections being formed at least in part from a pavement material, said expansion joint being adapted to accommodate changes in spacing between the ends resulting from thermal contraction and expansion and comprising:

first box means adapted to be embedded in the pavement material of the end of one of the sections, said first box means having a first top member with a top surface which is adapted to be substantially coplanar with the top driving surface, first wall means extending downwardly from said first top member into the pavement material of the end of the one of the sections, and first fastening means arranged in a generally U-shaped pattern extending in a generally horizontal plane removably fastening said first top member to said first wall means;

second box means adapted to be embedded in the pavement material of the end of the other of the sections in substantial longitudinal alignment with said first box means, said second box means having a second top member with a top surface which is adapted to be substantially coplanar with the top driving surface, second wall means extending downwardly from said second top member into the pavement material of the other of the sections, and second fastening means arranged in a generally U-shaped pattern extending in a generally horizontal plane removably fastening said second top member to said second wall means;

a support rail extending between said first box means and said second box means, said support rail having a first end within said first box means and a second end within said second box means;

first slidable support means within said first box means slidably supporting said first end of said support rail;

second slidable support means within said second box means slidably supporting said second end of said support rail; and an intermediate rail attached to and supported by said support rail and extending generally transversely thereof, said intermediate rail being adapted to be spaced from the spaced apart ends of the sections and to extend generally parallel thereto, said intermediate rail having a top surface which is adapted to be substantially coplanar with the driving surface.

2. An expansion joint according to claim 1 and further comprising:

control spring means acting in opposed directions on said support rail and longitudinally of said support rail, said control spring means being adapted to space said intermediate rail substantially equidistantly between the spaced apart ends of the sections.

3. An expansion joint for use between spaced apart ends of adjacent sections of the highway, bridge or the like having a top driving surface, each of the sections being formed at least in part from a pavement material, said expansion joint being adapted to accommodate changes in spacing between the ends resulting from thermal contraction and expansion and comprising:

first box means adapted to be embedded in the pavement material of the end of one of the sections, said first box means having a first top member with a top surface which is adapted to be substantially coplanar with the top driving surface, first wall means extending downwardly from said first top member into the pavement material of the end of the one of the sections, and first fastening means removably fastening said first top member to said first wall means;

second box means adapted to be embedded in the pavement material of the end of the other of the sections in substantial longitudinal alignment with said first box means, said second box means having a second top member with a top surface which is adapted to be substantially coplanar with the top driving surface, second wall means extending downwardly from said second top member into the pavement material of the other of the sections, and second fastening means removably fastening said second top member to said second wall means;

a support rail extending between said first box means and said second box means, said support rail having a first end within said first box means and a second end within said second box means;

first slidable support means within said first box means slidably supporting said first end of said support rail;

second slidable support means within said second box means slidably supporting said second end of said support rail; and an intermediate rail attached to and supported by said support rail and extending generally transversely thereof, said intermediate rail being adapted to be spaced from the spaced apart ends of the sections and to extend generally parallel thereto, said intermediate rail having a top surface which is adapted to be substantially coplanar with the driving surface;

wherein each of said first top member and said second top member comprises a metallic plate and a first layer of an organic material on top of said metallic plate and secured thereto, said first layer of an organic material having a top surface, said top surface of each of said first top member and said second top member being said top surface of said first layer of said organic material on said metallic plate of each of said first top member and said second top member.

4. An expansion joint according to claim 3 wherein said each of said first top member and said second top member further comprises a second layer of an organic material on the bottom of said metallic plate and secured thereto, said second layer of said each of said first top member and said second top member engaging the one of the first wall means and second wall means to which said one of said first top member and said second top member is removably fastened and serving as a gasket therebetween.

5. An expansion joint according to claim 4 wherein said first layer of an organic material and said second layer of an organic material of said each of said first top member and said second top member are formed integrally with one another from the same organic material.

6. An expansion joint according to claim 5 wherein said same organic material is a relatively hard, elastomeric material.

7. An expansion joint according to claim 6 wherein said elastomeric material is polyurethane.

8. An expansion joint according to claim 5 wherein said metallic plate of said each of said first top plate and said second top plate has first aperture means extending therethrough, and wherein said same organic material fills said first aperture means and integrally joins said first layer and said second layer of said each of said first top plate and said second top plate.

9. An expansion joint according to claim 8 wherein said first aperture means comprises a plurality of spaced apart apertures.

10. An expansion joint according to claim 8 wherein said metallic plate of said each of said first top plate and said second top plate further has an edge extending between said first layer and said second layer of said each of said first top plate and said second top plate, and wherein said same organic material is further bonded to at least a major portion of said edge of said metallic plate of said each of said first top plate and said second top plate and further integrally joins each of said first layer and said second layer of said first top plate and said second top plate, said same organic material along said at least a major portion of said edge of said each of said first top plate and said second top plate being adapted to seal said each of said first top plate and said second top plate from surrounding portions of the sections in which the one of said first box means and said second box means which include said one of said first top plate and said second top plate is adapted to be embedded.

11. An expansion joint according to claim 3 wherein each of said first fastening means and said second fastening means comprises a plurality of threaded fasteners, each of said plurality of threaded fasteners having a top which is positioned below said top surface of said first layer of organic material of said each of said first top plate and said second top plate which incorporates said each of said first fastening means and said second fastening means, and wherein said first layer of an organic material of said each of said first top plate and said second top plate has second aperture means in the form of a plurality of apertures, each of said plurality of apertures being aligned with one of said plurality of threaded fasteners, and further comprising:

a plurality of removable plugs, one of said plurality of removable plugs being removably inserted in said each of said plurality of apertures, said one of said plurality of removable plugs, upon its removal from said each of said plurality of apertures, permitting the insertion of one of said plurality of fasteners through said each of said plurality of apertures and the removal of said one of said plurality of fasteners therethrough, said one of said plurality of removable plugs normally sealingly closing said each of said plurality of apertures.

12. An expansion joint according to claim 11 wherein each of said plurality of removable plugs is formed from a second organic material.

13. An expansion joint according to claim 12 wherein said second organic material is a relatively hard, elastomeric material.

14. An expansion joint according to claim 13 wherein said second organic material is polyurethane.

15. An expansion joint according to claim 3 wherein each of the spaced apart ends has first and second spaced apart edge rail sections embedded therein, each of the first and second spaced apart edge rail sections having a top surface which is substantially coplanar with the driving surface, and wherein each of said first top member and said second top member has a third edge rail section affixed thereto, said third edge rail section of each of said first top member and said second top member being adapted to form a substantially continuous edge rail with the first and second edge rail sections of the one of the spaced apart ends in which the one of said first box means and said second box means having said each of said first top member and said second top member is adapted to be embedded.

16. An expansion joint according to claim 15 wherein each of said third edge rail sections is adapted to form narrow gaps with the edge rail section with which it forms a substantially continuous edge rail, and further comprising sealing means adapted to fill each of said narrow gaps.

17. An expansion joint according to claim 13 wherein each of said plurality of apertures has a reverse taper, and wherein said one of said plurality of removable plugs in said each of said plurality of apertures has a reverse taper and forms an interference fit with said each of said plurality of apertures.

18. An expansion joint according to claim 1 and further comprising:

sealing means adapted to extend between said intermediate rail and each of the spaced apart ends, said sealing means comprising a first elastomeric membrane adapted to be positioned between said intermediate rail and the end of one of the sections and a second elastomeric membrane adapted to be positioned between said intermediate rail and the end of the other of the sections.

19. An expansion joint according to claim 1 wherein each of said first slidable support means and said second slidable support means comprises upper slidable support means and lower slidable support means, said upper slidable support means and said lower slidable support means of said first slidable support means each slidably engaging said first end of said support rail, said upper slidable support means and said lower slidable support means of said second slidable support means each slidably engaging said second end of said support rail.

20. An expansion joint according to claim 15 and further comprising:

sealing means adapted to extend between said intermediate rail and the substantially continuous edge rail of one of the spaced apart ends, said sealing means comprising a first elastomeric membrane having a first edge portion which is sealingly engaged by said intermediate rail and a second edge portion which is adapted to be sealingly engaged by the substantially continuous edge rail of the one of the spaced apart ends.

21. An expansion joint according to claim 20 and further comprising:

second sealing means adapted to extend between said intermediate rail and the substantially continuous edge rail of the other of the spaced apart ends.

22. An expansion joint for use between spaced apart ends of the adjacent sections of a structure which a vehicle is adapted to drive over, the structure having a top driving surface, each of the sections being formed from a pavement material, said expansion joint being adapted to accommodate changes in spacing between the ends resulting from thermal contraction and expansion and comprising:

first box means adapted to be embedded in the pavement material of the end of one of the sections, said first box means having a first top member with a top surface which is adapted to be substantially coplanar with the top driving surface, first wall means extending downwardly from said first top member into the pavement material of the end of the one of the sections, and first fastening means arranged in a generally U-shaped pattern extending in a generally horizontal plane removably fastening said first top member to said first wall means;

second box means adapted to be embedded in the pavement material of the end of the other of the sections in substantial longitudinal alignment with said first box means, said second box means having a second top member with a top surface which is adapted to be substantially coplanar with the top driving surface, second wall means extending downwardly from said second top member into the pavement material of the other of the sections, and second fastening means arranged in a generally U-shaped pattern extending in a generally horizontal plane removably fastening said second top member to said second wall means;

a plurality of spaced apart, substantially parallel support rails extending between said first box means and said second box means, each of said plurality of support rails having a first end within said first box means and a second end within said second box means;

first slidable support means within said first box means slidably supporting said first end of each of said plurality of support rails;

second slidable support means within said second box means slidably supporting said second end of each of said plurality of support rails; and a plurality of spaced apart, substantially parallel intermediate rails, each of said intermediate rails being attached to and supported by one of said support rails and extending generally transversely thereof, said plurality of intermediate rails being adapted to be spaced from the spaced apart ends of the sections and to extend generally parallel thereto, each of said plurality of intermediate rails having a top surface which is adapted to be substantially coplanar with the driving surface.

23. An expansion joint according to claim 22 and further comprising:

control spring means acting in opposed directions on each of said plurality of support rails and longitudinally of said each of said plurality of support rails, said control spring means being adapted to space said plurality of intermediate rails substantially equidistantly between the spaced apart ends of the sections and from each other.

24. An expansion joint for use between spaced apart ends of adjacent sections of a highway, bridge or the like, the highway, bridge or the like having a top driving surface, each of the sections being formed from a pavement material, said expansion joint being adapted to accommodate changes in spacing between the ends resulting from thermal contraction and expansion and comprising:

first box means adapted to be embedded in the pavement material of the end of one of the sections, said first box means having a first top member with a top driving surface, first wall means extending downwardly from said first top member into the pavement material of the end of the one of the sections, and first fastening means removably fastening said first top member to said first wall means;

second box means adapted to be embedded in the pavement material of the end of the other of the sections in substantial longitudinal alignment with said first box means, said second box means having a second top member with a top surface which is adapted to be substantially coplanar with the top driving surface, second wall means extending downwardly from said second top member into the pavement material of the other of the sections, and second fastening means removably fastening said second top member to said second wall means;

a plurality of spaced apart, substantially parallel support rails extending between said first box means and said second box means, each of said plurality of support rails having a first end within said first box means and a second end within said second box means;

first slidable support means within said first box means slidably supporting said first end of each of said plurality of support rail;

second slidable support means within said second box means slidably supporting said second end of each of said plurality of support rails; and a plurality of spaced apart, substantially parallel intermediate rails, each of said intermediate rails being attached to and supported by one of said support rails and extending generally transversely thereof, said plurality of intermediate rails being adapted to be spaced from the spaced apart ends of the sections and to extend generally parallel thereto, each of said plurality of intermediate rails having a top surface which is adapted to be substantially coplanar with the driving surface;

wherein each of said first top member and said second top member comprises a metallic plate and a first layer of an organic material on top of said metallic plate and secured thereto, said first layer of an organic material having a top surface, aid top surface of each of said first top member and said second top member being said top surface of said first layer of said organic material on said metallic plate of each of said first top member and said second top member.

25. An expansion joint according to claim 24 wherein each of the spaced apart ends has first and second spaced apart edge rail sections embedded therein, each of the spaced apart edge rail sections having a top surface which is substantially coplanar with the driving surface, and wherein each of said first top member and said second top member has a third edge rail section affixed thereto, said third edge rail section of each of said first top member and said second top member being adapted to form a substantially continuous edge rail with the first and second edge rail sections of the one of the spaced apart ends in which the one of said first box means and said second box means having said each of said first top member and said second top member is adapted to be embedded.

26. An expansion joint according to claim 25 wherein each of said third edge rail segments is adapted to form narrow gaps with the edge rail section with which it forms a substantially continuous edge rail, and further comprising sealing means adapted to fill each of said narrow gaps.

27. An expansion joint according to claim 25 and further comprising:

first sealing means adapted to sealingly extend between the substantially continuous edge rail of one of the spaced apart ends, and the one of said plurality of spaced apart intermediate rails which is adjacent to the one of the spaced apart ends, said first sealing means comprising a first elastomeric membrane;

second sealing means adapted to sealingly extend between the substantially continuous edge rail of the other of the spaced apart ends and the one of said plurality of spaced apart intermediate rails which is adjacent to the other of the spaced apart ends, said second sealing means comprising a second elastomeric membrane; and a number of third sealing means, said number of third sealing means being one less than the number of said plurality of intermediate rails, each of said third sealing means sealingly extending between an adjacent pair of said plurality of intermediate rails and comprising a third elastomeric membrane.

28. An expansion joint according to claim 22 and further comprising:

a plurality of sealing means extending between each adjacent pair of said plurality of intermediate rails and between each of the spaced apart ends and the one of said plurality of intermediate rails which is adjacent to said each of the spaced apart ends, each of said plurality of sealing means comprising an elastomeric membrane.

29. In combination with adjacent sections of a structure which a vehicle is adapted to drive over, said structure having a top driving surface, said adjacent sections having spaced apart ends and being formed at least in part from a pavement material, an expansion joint for accommodating changes in spacing between said spaced apart ends resulting from thermal contraction and expansion and comprising;

first box means embedded in the pavement material of the end of one of said sections, said first box means having a first top member with a top surface which is substantially coplanar with said top driving surface, first wall means extending downwardly from said first top member into the pavement material of said end of one of the said sections, and first fastening means arranged in a generally U-shaped pattern extending in a generally horizontal plane removably fastening said first top member to said first wall means;

second box means embedded in the pavement material of the end of the other of said sections, said second box means having a second top member with a top surface which is substantially coplanar with said top driving surface, second wall means extending downwardly from said second top member into the pavement material of said end of the other of said sections, and second fastening means arranged in a generally U-shaped pattern extending in a generally horizontal plane removably fastening said second top member to said second wall means;

a support rail extending between said first box means and said second box means, said support rail having a first end within said first box means and a second end within said second box means;

first slidable support means within said first box means slidably supporting said first end of said support rail;

second slidable support means within said second box means slidably supporting said second end of said support rail; and an intermediate rail attached to and supported by said support rail and extending generally transversely thereof, said intermediate rail being spaced from said spaced apart ends of said sections and extending generally parallel thereto, said intermediate rail having a top surface which is substantially coplanar with said driving surface.

30. A combination according to claim 29 and further comprising:

control spring means acting in opposed directions on said support rail and longitudinally of said support rail, said control spring means spacing said intermediate rail substantially equidistantly between said spaced apart ends of said sections.

31. In combination with adjacent sections of a highway, bridge or the like having a top driving surface, said adjacent sections having spaced apart ends and being formed at least in part from a pavement material, an expansion joint for accommodating changes in spacing between said spaced apart ends resulting from thermal contraction and expansion and comprising:

first box means embedded in the pavement material of the end of one of said sections, said first box means having a first top member with a top surface which is substantially coplanar with said top driving surface, first wall means extending downwardly from said first top member into the pavement material of said end of one of said sections, and first fastening means removably fastening said first top member to said first wall means;

second box means embedded in the pavement material of the end of the other of said sections, said second box means having a second top member with a top surface, second wall means extending downwardly from said second top member into the pavement material of said end of the other of said sections, and second fastening means removably fastening said second top member to said second wall means;

a support rail extending between said first box means and said second box means, said support rail having a first end within said first box means and a second end within said second box means;

first slidable support means within said first box means slidably supporting said first end of said support rail;

second slidable support means within said second box means slidably supporting said second end of said support rail;

an intermediate rail attached to and supported by said support rail and extending generally transversely thereof, said intermediate rail being spaced from said spaced apart ends of said sections and extending generally parallel thereto, said intermediate rail having a top surface which is substantially coplanar with said driving surface;

wherein each of said first top member and said second top member comprises a metallic plate and a first layer of an organic material on top of said metallic plate and secured thereto, said first layer of an organic material having a top surface, said top surface of each of said first top member and said second top member being said top surface of said first layer of said organic material on said metallic plate of said each of said first top member and said second top member.

32. A combination according to claim 31 wherein said each of said first top member and said second top member further comprises a second layer of an organic material on the bottom of said metallic plate and secured thereto, said second layer of said each of said first top member and said second top member engaging the one of the first wall means and second wall means to which said one of said first top member and said second top member is removably fastened and serving as a gasket therebetween.

33. A combination according to claim 32 wherein said first layer of an organic material and said second layer of an organic material of said each of said first top member and said second top member are formed integrally with one another from the same organic material.

34. A combination according to claim 33 wherein said organic material is a relatively hard, elastomeric material.

35. A combination according to claim 34 wherein said elastomeric material is polyurethane.

36. A combination according to claim 35 wherein said metallic plate of said each of said first top plate and said second top plate has first aperture means extending therethrough, and wherein said first same organic material fills said aperture means and integrally joins said first layer and said second layer of said each of said first top plate and said second top plate.

37. A combination according to claim 36 wherein said aperture first means comprises a plurality of spaced apart apertures.

38. A combination according to claim 36 wherein said metallic plate of said each of said first top plate and said second top plate further has an edge extending between said first layer and said second layer of said each of said first top plate and said second top plate, and wherein said same organic material is further bonded to at least a major portion of said edge of said metallic plate of said each of said first top plate and said second top plate and further integrally joins each of said first layer and said second layer of each of said first top plate and said second top plate, said same organic material extending along said at least a major portion of said edge of said each of said first top plate and said second top plate and sealing said each of said first top plate and said second top plate from surrounding portions of the section in which said one of said first box means and said second box means which include said one of said first top plate and said second top plate is embedded.

39. A combination according to claim 31 wherein each of said first fastening means and said second fastening means comprises a plurality of threaded fasteners, each of said plurality of threaded fasteners having a top which is positioned below said top surface of said first layer of organic material of said each of said first top plate and said second top plate which incorporates said each of said first fastening means and said second fastening means, and wherein said first layer of an organic material of said each of said first top plate and said second top plate has second aperture means in the form of a plurality of apertures, each of said plurality of apertures being aligned with one of said plurality of threaded fasteners, and further comprising:

a plurality of removable plugs, one of said plurality of removable plugs being removably inserted in said each of said plurality of apertures, said one of said plurality of removable plugs, upon its removal from said each of said plurality of apertures, permitting the insertion of one of said plurality of fasteners through said each of said plurality of apertures and the removal of said one of said plurality of fasteners therethrough, said one of said plurality of removable plugs normally sealingly closing said each of said plurality of apertures.

40. A combination according to claim 39 wherein each of said plurality of removable plugs is formed from a second organic material.

41. An expansion joint according to claim 40 wherein said second organic material is a relatively hard, elastomeric material.

42. A combination according to claim 41 wherein said second organic material is polyurethane.

43. A combination according to claim 30 wherein each of said spaced apart ends has first and second spaced apart edge rail sections embedded therein, each of said first and second spaced apart edge rail sections having a top surface which is substantially coplanar with the driving surface, and wherein each of said first top member and said second top member has a third edge rail section affixed thereto, said third edge rail section of each of said first top member and said second top member forming a substantially continuous edge rail with the first and second edge rail sections of the one of the spaced apart ends in which the one of said first box means and said second box means having said each of said first top member and said second top member is embedded.

44. A combination according to claim 43 wherein each of said third edge rail segments forms narrow gaps with the edge rail sections with which it forms a substantially continuous edge rail, and further comprising sealing means filling each of said narrow gaps.

45. A combination according to claim 41 wherein each of said plurality of apertures has a reverse taper, and wherein said one of said plurality of removable plugs in said each of said plurality of apertures has a reverse taper and forms an interference fit with said each of said plurality of apertures.

46. A combination according to claim 29 wherein each of said first slidable support means and said second slidable support means comprises upper slidable support means and lower slidable support means, said upper slidable support means and said lower slidable support means of said first slidable support means each slidably engaging said first end of said support rail, said upper slidable support means and said lower slidable support means of said second slidable support means each slidably engaging said second end of said support rail.

47. A combination according to claim 43 and further comprising:

sealing means extending between said intermediate rail and the substantially continuous edge rail of one of said spaced apart ends, said sealing means comprising a first elastomeric membrane having a first edge portion which is sealingly engaged by said intermediate rail and a second edge portion which is sealingly engaged by the substantially continuous edge rail of said one of said spaced apart ends.

48. A combination according to claim 47 and further comprising:

second sealing means extending between said intermediate rail and the substantially continuous edge rail of the other of said spaced apart ends.

49. In combination with adjacent sections of a structure which a vehicle is adapted to drive over, said structure having a top driving surface, said adjacent sections having spaced apart ends and being formed at least in part from a pavement material, an expansion joint for accommodating changes in spacing between said spaced apart ends resulting from thermal contraction and expansion and comprising;

first box means embedded in the pavement material of the end of one of said sections, said first box means having a first top member with a top surface which is substantially coplanar with said top driving surface, first wall means extending downwardly from said first top member into the pavement material of said end of one of said sections, and first fastening means arranged in a generally U-shaped pattern extending in a generally horizontal plane removably fastening said first top member to said first wall means;

second box means embedded in the pavement material of the end of the other of said sections, said second box means having a second top member with a top surface which is substantially coplanar with said top driving surface, second wall means extending downwardly from said second top member into the pavement material of said end of the other of said sections, and second fastening means arranged in a generally U-shaped pattern extending in a generally horizontal plane removably fastening said second top member to said second wall means;

a plurality of spaced apart, substantially parallel support rails extending between said first box means and said second box means, each of said support rails having a first end within said first box means and a second end within said second box means;

first slidable support means within said first box means slidably supporting said first end of each of said support rails;

second slidable support means within said second box means slidably supporting said second end of each of said support rails; and a plurality of spaced apart substantially parallel intermediate rails, each of said intermediate rails being attached to and supported by one of said support rails and extending generally transversely thereof, said plurality of intermediate rails being spaced from the spaced ends of said sections and extending generally parallel thereto, each of said plurality of intermediate rails having a top surface which is substantially coplanar with the driving surface.

50. A combination according to claim 49 and further comprising:

control spring means acting in opposed directions on each of said plurality of said support rails and longitudinally of said each of said plurality of support rails, said control spring means spacing said plurality of intermediate rails substantially equidistantly between the spaced apart ends of said sections and from each other.

51. In combination with adjacent sections of a highway, bridge or the like having a top driving surface, said adjacent sections having spaced apart ends and being formed at least in part from a pavement material, an expansion joint for accommodating changes in spacing between said spaced apart ends resulting from thermal contraction and expansion and comprising:

first box means embedded in the pavement material of the end of one of said sections, said first box mean having a first top member with a top surface which is substantially coplanar with said top driving surface, first wall means extending downwardly from said first top member into the pavement material of said end of one of said sections, and first fastening means removably fastening said first top member to said first wall means;

second box means embedded in the pavement material of the end of the other of said sections, said second box means having a second top member with a top surface which is substantially coplanar with said top driving surface, second wall means extending downwardly from said second top member into the pavement material of said end of the other of said sections, and second fastening means removably fastening said second top member to said second wall means;

a plurality of spaced apart, substantially parallel support rails extending between said first box means and said second box means, each of said support rails having a first end within said first box means and a second end within said second box means;

first slidable support means within said first box mean slidably supporting said first end of each of said support rails;

second slidable support means within said second box means slidably supporting said second end of each of said support rails;

a plurality of spaced apart substantially parallel intermediate rails, each of said intermediate rails being attached to and supported by one of said support rails and extending generally transversely thereof, said plurality of intermediate rails being spaced from the spaced ends of said sections and extending generally parallel thereto, each of said plurality of intermediate rails having a top surface which is substantially coplanar with the driving surface;

wherein each of said first top member and said second top member comprises a metallic plate and a first layer of an organic material on top of said metallic plate and secured thereto, said first layer of an organic material having a top surface, said top surface of each of said first top member and said second top member being said top surface of said first layer of said organic material on said metallic plate of each of said first top member and said second top member.

52. A combination according to claim 51 wherein each of the spaced apart ends has first and second spaced apart edge rail sections embedded therein, each of the spaced apart edge rail sections having a top surface which is substantially coplanar with the driving surface, and wherein each of said first top member and said second top member has a third edge rail section affixed thereto, said third edge rail section of each of said first top member and said second top member forming a substantially continuous edge rail with the first and second edge rail sections of the one of the spaced apart ends in which the one of said first box means and said second box means having said each of said first top member and said second top member is embedded.

53. A combination according to claim 52 wherein each of said third edge rail segments forms narrow gaps with the edge rail sections with which it forms a substantially continuous edge rail, and further comprising sealing means filling each of said narrow gaps.

54. A combination according to claim 52 and further comprising:

first sealing means sealingly extending between the substantially continuous edge rail of one of said spaced apart ends and the one of said plurality of spaced apart intermediate rails which is adjacent to said one of said spaced apart ends, said first sealing means comprising a first elastomeric membrane;

second sealing means sealingly extending between the substantially continuous edge rail of the other of said spaced apart ends and the one of said plurality of spaced apart intermediate rails which is adjacent to said other of said spaced apart ends, said second sealing means comprising a second elastomeric membrane; and a number of third sealing means, said number of third sealing means being one less than the number of said plurality of intermediate rails, each of said third sealing means sealingly extending between an adjacent pair of said plurality of intermediate rails and comprising a third elastomeric membrane.

55. A combination according to claim 29 and further comprising:

a plurality of sealing means extending between each adjacent pair of intermediate rails and between each of the spaced apart ends and the one of said plurality of intermediate rails which is adjacent to said each of said spaced apart ends, said each of said plurality of sealing means comprising an elastomeric membrane.

* * * * *

UNITED STATES PATENT AND TRADEMARK OFFICE

CERTIFICATE OF CORRECTION

PATENT NO. : 4,923,328

DATED : May 8, 1990

INVENTOR(S) : David H. Arps, Howard R. Brown, Roy J. Lanham and Donald E. Weiker It is certified that error appears in the above-identified patent and that said Letters Patent is hereby corrected as shown below:

Col. 2, line 55, change "high" to --highway which--.

Col. 2, line 59, "illustrate" should be --illustrated--.

Col. 7, after line 50, insert --38 and 40 and to the backplate 36 of the box therebelow, and--.

Col. 14, line 16, change "highway, bridge or the like" (1st occurrence) to read --structure which a vehicle is adapted to drive over-- and change "highway, bridge or the like" (2nd occurrence) to read --structure--.

Col. 15, line 1, change "aid" to --said--.

Signed and Sealed this

Twelfth Day of November, 1991

*Attest:*

HARRY F. MANBECK, JR.

*Attesting Officer*

*Commissioner of Patents and Trademarks*